US012122637B2

(12) United States Patent
Miyachi et al.

(10) Patent No.: US 12,122,637 B2
(45) Date of Patent: Oct. 22, 2024

(54) CONVEYANCE DEVICE

(71) Applicant: RISO KAGAKU CORPORATION, Tokyo (JP)

(72) Inventors: Ryosuke Miyachi, Ibaraki (JP); Yoshihisa Morita, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 148 days.

(21) Appl. No.: 17/684,852

(22) Filed: Mar. 2, 2022

(65) Prior Publication Data

US 2022/0289507 A1 Sep. 15, 2022

(30) Foreign Application Priority Data

Mar. 9, 2021 (JP) ..... 2021-037194

(51) Int. Cl.
*B65H 9/04* (2006.01)
*B65H 5/00* (2006.01)

(52) U.S. Cl.
CPC ..... *B65H 9/04* (2013.01); *B65H 5/00* (2013.01); *B65H 2301/3422* (2013.01)

(58) Field of Classification Search
CPC ..... B65H 5/38; B65H 9/04; B65H 2405/141; B65H 2405/1142
See application file for complete search history.

(56) References Cited

U.S. PATENT DOCUMENTS 9,592,681 B2 * 3/2017 Ito ..... B65H 5/068
2007/0231032 A1 * 10/2007 Matsuno ..... G03G 15/6558 399/388
2013/0135411 A1 5/2013 Ito et al.

FOREIGN PATENT DOCUMENTS

JP 2007-293263 11/2007
JP 2013-111838 6/2013
JP 2016-183039 10/2016
JP 2019-189367 10/2019

OTHER PUBLICATIONS

Sep. 10, 2024 Japanese Office Action in corresponding Japanese Application No. 2021-037194 and English translation thereof.

* cited by examiner

*Primary Examiner* — Howard J Sanders
(74) *Attorney, Agent, or Firm* — GREENBLUM & BERNSTEIN, P.L.C.

(57) ABSTRACT

A conveyance device includes a conveyance path having a curved portion and a pair of conveyers which are disposed in the conveyance path and convey a medium while nipping it, wherein the medium enters the pair of conveyers in a state of being at least partially curved in the curved portion, and the conveyance path guides the medium toward one of the pair of conveyers.

6 Claims, 5 Drawing Sheets

CONVEYANCE DEVICE

CROSS-REFERENCE TO RELATED APPLICATION

This application is based upon and claims the benefit of priority of the prior Japanese Patent Application No. 2021-037194, filed on Mar. 9, 2021, the entire contents of which are incorporated herein by reference.

FIELD

The embodiments discussed herein are related to a conveyance device for conveying a medium.

BACKGROUND

Conventionally, a post-processing device that detects the tilt of paper and corrects the tilt of paper in order to adjust the tilt of paper against the conveyance direction in the case where a paper conveyance path is bent has been proposed (see, for example, Japanese Laid-open Patent Publication No. 2016-183039).

SUMMARY

In an aspect, a conveyance device includes a conveyance path having a curved portion, and a pair of conveyers that are disposed in the conveyance path and convey a medium while nipping it, and the medium enters the pair of conveyers in a state of being at least partially curved in the curved portion, and the conveyance path guides the medium toward one of the pair of conveyers.

The object and advantages of this invention may be realized by the elements described in the claims and the combinations thereof.

DESCRIPTION OF EMBODIMENTS

In the case where a conveyance path has a curved portion in a conveyance device that conveys a medium such as a paper sheet, a medium to be conveyed gets into a state of being at least partially curved in the curved portion when it enters a pair of conveyance members disposed downstream from the curved portion or at the curved portion.

In some cases, the distance between a pair of guide plates is wider in the curved portion of a conveyance path than in the straight portion thereof in order to reduce the conveyance resistance. Especially in this case, the degree of freedom of a medium is so high in the curved portion that the position of the tip of the medium is not stabilized. Therefore, for example, the tip of the medium on one side in the width direction (e.g., the front side of the device) may be in contact with one of a pair of conveyance members, and the tip of the medium on the other side in the width direction (e.g., the rear side of the device) may be in contact with the other of the pair of conveyance members. When in this way the tips of a medium come into contact with conveyance members different between the one side and the other side in the width direction, the difference in frictional force (conveyance force) between the pair of conveyance members tends to cause the medium to skew. The smaller in size or thinner the media is, the higher it is in degree of freedom in the curved portion, and the more likely the medium are to come into contact with conveyance members different between one side and the other side in the width direction at its tips, and therefore, it is likely to skew.

Then, although it is also conceivable to detect the tilt of a medium and correct the tilt of the medium as described above, it follows that a sensor to detect the skewing of the medium and a skewing correction unit to correct the skewing of the medium in accordance with the detection result of this sensor, and the like are disposed, and therefore, the structure is made to be more complicated.

As follows, the conveyance device according to an embodiment of this invention is explained with reference to the drawings.

Figure 1:
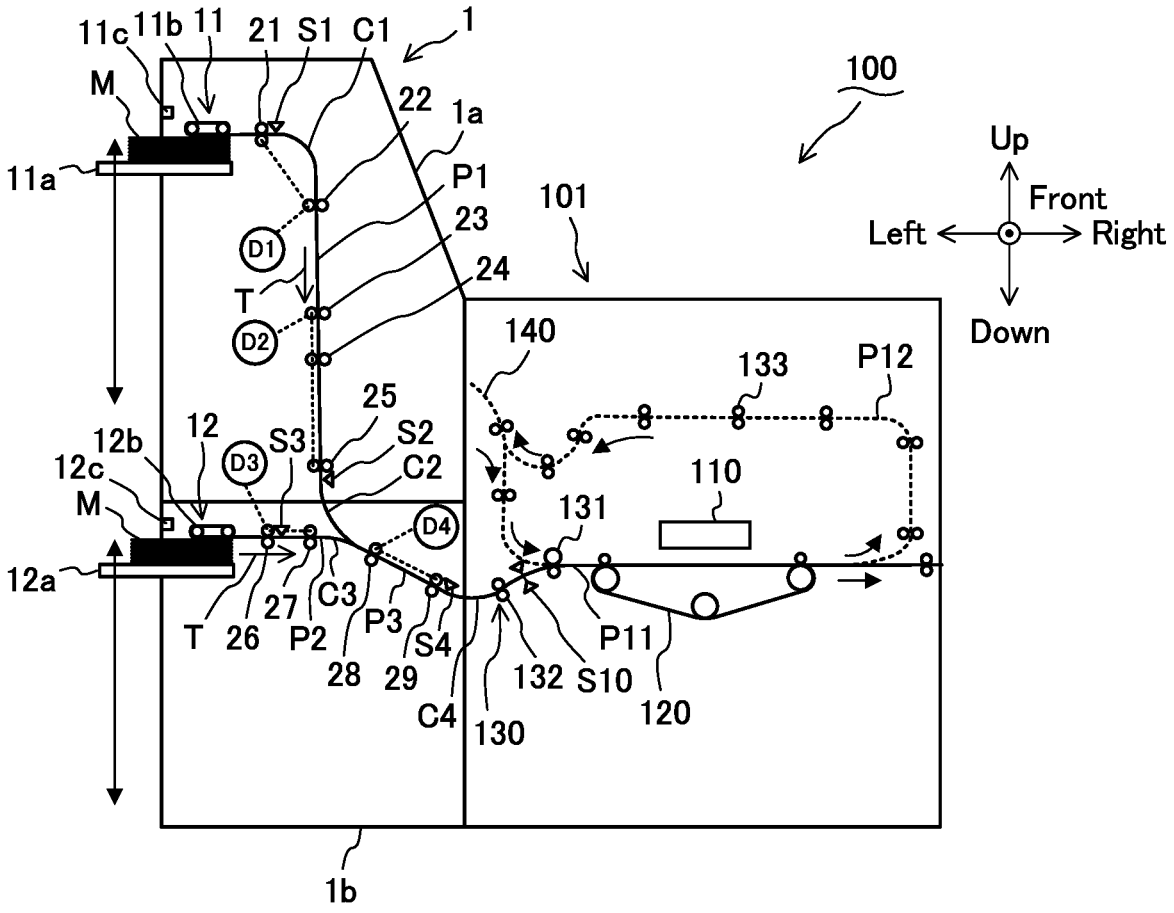
FIG. 1 is a front view showing the internal structure of a printing system in one embodiment.

FIG. 1 is a front view showing the internal structure of a printing system 100.

Figure 2:
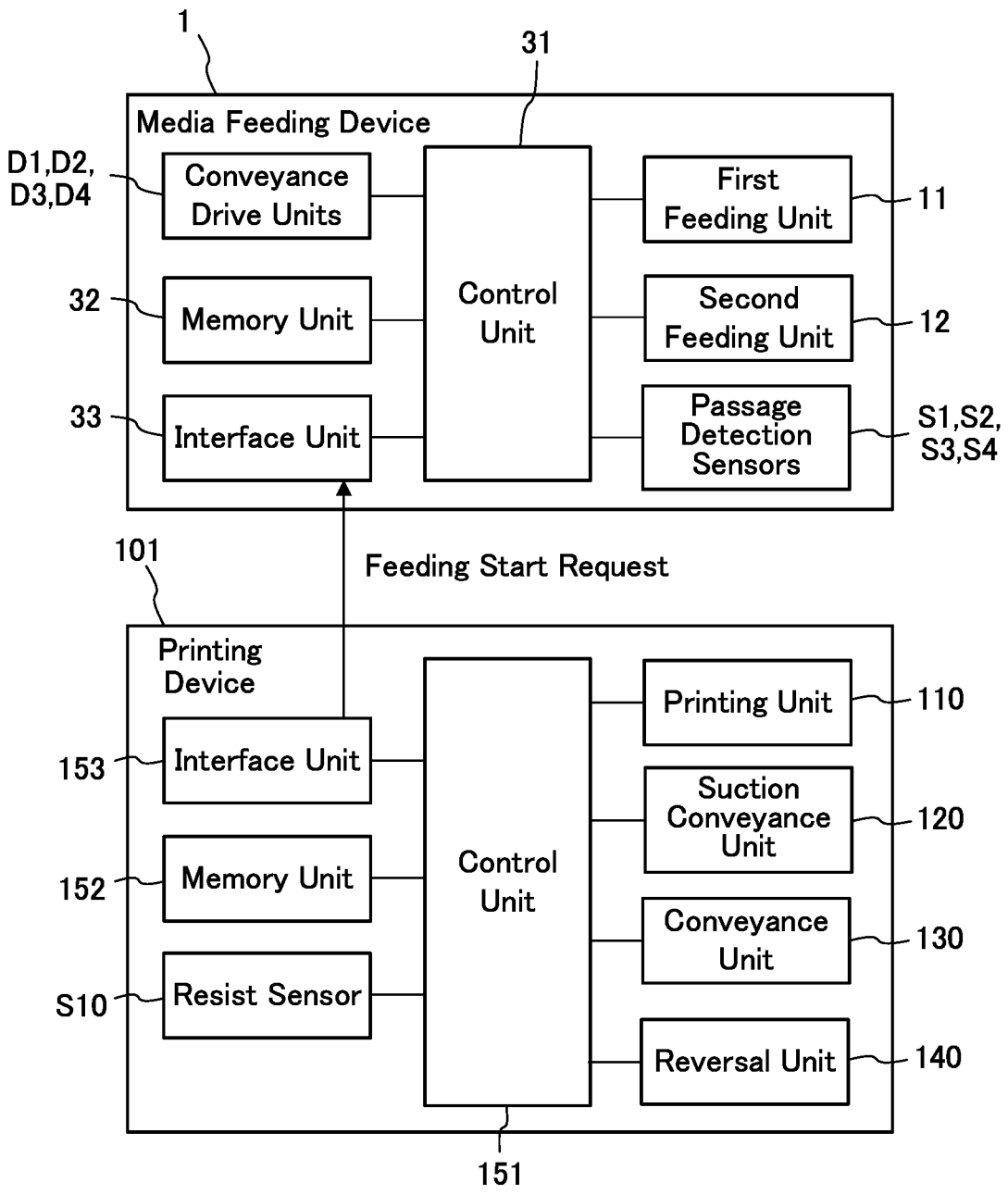
FIG. 2 is a figure showing the configuration of controlling a media feeding device and a printing device in one embodiment.

FIG. 2 is a drawing showing a configuration of controlling a media feeding device 1 and a printing device 101.

Each of the back-to-front, up-and-down, and right-to-left directions shown in FIG. 1 and the FIGS. 3 to 5 described below is merely a direction for convenience of explanation, and for example, the back-to-front direction and the right-to-left direction are horizontal directions, and the up-and-down direction is a vertical direction.

The printing system 100 shown in FIG. 1 includes a media feeding device 1 and a printing device 101. It suffices that the conveyance device according to this embodiment includes a conveyance path such as the first individual conveyance path P1 described below, of the media feeding device 1 and a pair of conveyance members (conveyers) such as the second conveyance roller pair 22 described below, of the media feeding device 1. Therefore, in this embodiment, each of the media feeding device 1 and the printing system 100 functions as an example of a conveyance device for conveying media M. However, the conveyance device according to this embodiment may be a processing device such as a printing device 101 which performs processing such as printing on the media M, or a conveyance device only for conveying the media M.

A media feeding device 1 feeds media M to the printing device 101 which is an example of a destination device for the media M. The destination device may be any other device such as a post-processing device. Additionally, the media feeding device 1 may be integrally included in a destination device such as the printing device 101. In addition, the medium M is, for example, a paper sheet (paper leaf), but it may also be other sheet-like media such as a film.

As shown in FIG. 1, a media feeding device 1 includes a first feeding unit 11, a second feeding unit 12, a first individual conveyance path P1, a second individual conveyance path P2, a confluent conveyance path P3, first to ninth conveyance roller pairs 21 to 29, first to fourth conveyance drive units (conveyance drives) D1 to D4, a first entrance passage detection sensor S1, a first exit passage detection sensor S2, a second entrance passage detection sensor S3, and a second exit passage detection sensor S4. Additionally, as shown in FIG. 2, the media feeding device 1 also includes a control unit (controller) 31, a memory unit (memory) 32, and an interface unit 33.

A media feeding device 1 is divided into an upper stage 1*a* and a lower stage 1*b*, wherein a first feeding unit 11 is disposed in the upper stage 1*a* and a second feeding unit 12 is disposed in the lower stage 1*b*. In this way, the first feeding unit 11 and the second feeding unit 12 are disposed in vertical alignment. The first feeding unit 11 and the second feeding unit 12 are examples of a feeding unit (feeder) for feeding media M. This feeding unit may consist of a single feeding unit, or three or more feeding units. Additionally, the direction in which a plurality of feeding units are aligned may be a back-to-front direction or a right-to-left direction, and is not particularly limited.

The first feeding unit 11 and the second feeding unit 12, respectively, have loading tables 11*a* and 12*a*, suction conveyance units (suction conveyers) 11*b* and 12*b*, and media thickness setting units (media thickness setting parts) 11*c* and 12*c*.

The loading tables 11*a* and 12*a* are loaded with a plurality of media M.

The suction conveyance units 11*b* and 12*b* have, for example, two pulleys and a belt hung over these pulleys, and reel off media M suctioned on the belt one by one through air suction, for example. The suction conveyance units 11*b*, 12*b* are examples of reel-off units of a first feeding unit 11 and a second feeding unit 12 that reel off the media M one by one.

In media thickness setting units 11*c* and 12*c*, the thickness of the media M loaded on the loading tables 11*a* and 12*a* is set by a user. For example, the media thickness setting units 11*c* and 12*c* have a lever or dial that can be moved to a position marked "thick paper" to indicate that the media M is thick paper, a position marked "plain paper" to indicate that the media M is plain paper, and a position marked "thin paper" to indicate that the media M is thin paper. The control unit 31 described later obtains information on the thickness of the medium M which is set in the medium thickness setting units 11*c* and 12*c*. The control unit 31 may also acquire the information on the thickness of the medium M which is set in the print job, by the operation panel of a printing device 101, or the like.

Additionally, although not shown in the figure, a first feeding unit 11 and a second feeding unit 12 have a loading table lifting and lowering drive unit (drive) such as a motor (an example of an actuator) that moves the loading tables 11*a* and 12*a* up and down, and a reel-out drive unit (drive) such as a motor (an example of an actuator) that rotates a drive pulley, which is one of the two pulleys of the suction conveyance units 11*b* and 12*b*.

Additionally, it is desirable that in the first feeding unit 11 and the second feeding unit 12, a levitating air blowing mechanism that blows levitating air to levitate a plurality of media M, including the uppermost medium M loaded on the loading tables 11*a* and 12*a*, and a separating air blowing mechanism that blows separating air to separate the uppermost medium M from the lower media M, and the like, are disposed.

A first individual conveyance path P1 is connected to a first feeding unit 11. A second individual conveyance path P2 is connected to a second feeding unit 12. A confluent conveyance path P3 is a conveyance path where the first individual conveyance path P1 and the second individual conveyance path P2 meet each other, and extends to the resist roller pair 131 of a printing device 101. The first individual conveyance path P1 and the second individual conveyance path P2 are examples of a plurality of individual conveyance paths connected to each of a plurality of the feeding units (the first feeding unit 11 and the second feeding unit 12).

A first individual conveyance path P1 is mostly disposed in the upper stage 1*a* of a media feeding device 1, and a second individual conveyance path P2 is disposed in the lower stage 1*b* of the media feeding device 1. The first individual conveyance path P1 meets the second individual conveyance path P2 in a confluent conveyance path P3 disposed in the lower stage 1*b*. Thus, the conveyance path of the media feeding device 1 has the first individual conveyance path P1, the second individual conveyance path P2, and a part of the confluent conveyance path P3. The first individual conveyance path P1 is larger in the length in the conveyance direction T than the second individual conveyance path P2.

Since the media M fed from a first feeding unit 11 is conveyed in a first individual conveyance path P1 and a confluent conveyance path P3, the conveyance route of the media M fed from the first feeding unit 11 passes through the first individual conveyance path P1 and the confluent conveyance path P3. In addition, since the media M fed from the second feeding unit 12 is conveyed in a second individual conveyance path P2 and the confluent conveyance path P3, the conveyance route of the media M fed from the second feeding unit 12 passes through the second individual conveyance path P2 and the confluent conveyance path P3.

A first individual conveyance path P1 has a first curved portion C1 which is provided between a first conveyance roller pair 21 and a second conveyance roller pair 22, and curves while changing the conveyance direction T from a rightward direction to a downward one, and a second curved portion C2 which is provided between a fifth conveyance roller pair 25 and an eighth conveyance roller pair 28, and curves while changing the conveyance direction T from a downward direction to a right downward one.

A second individual conveyance path P2 has a third curved portion C3 which is provided between a seventh conveyance roller pair 27 and an eighth conveyance roller pair 28, and curves while changing the conveyance direction T from a rightward direction to a right downward one.

A confluent conveyance path P3 has a fourth curved portion C4 which is provided between a ninth conveyance roller pair 29 and a resist roller pair 131 from a media feeding device 1 to a printing device 101, and curves while changing the conveyance direction T from a right downward direction to a right upward direction.

Each of first to ninth conveyance roller pairs 21 to 29 has a drive roller and a driven roller disposed in opposition to each other, and conveys a medium M while nipping it.

The first to fifth conveyance roller pairs 21 to 25 convey a medium M in the first individual conveyance path P1 of the upper stage 1*a* of a media feeding device 1. The sixth and seventh conveyance roller pairs 26 and 27 convey the medium M in the second individual conveyance path P2 of the lower stage 1*b* of the media feeding device 1. The eighth and ninth conveyance roller pairs 28 and 29 convey the medium M in the confluent conveyance path P3 of the lower stage 1*b* of the media feeding device 1. The first to fifth conveyance roller pairs 21 to 25 and the sixth and seventh conveyance roller pairs 26 and 27 are examples of a plurality of individual conveyance units (individual conveyers) that convey the medium M in the first individual conveyance path P1 and the second individual conveyance path P2 (a plurality of individual conveyance paths). Additionally, the eighth and ninth conveyance roller pairs 28 and 29 and the receiving roller pair 132 of a printing device 101, described below are examples of a confluent conveyance unit (confluent conveyer) that conveys the medium M in the confluent conveyance path P3.

Figure 3:
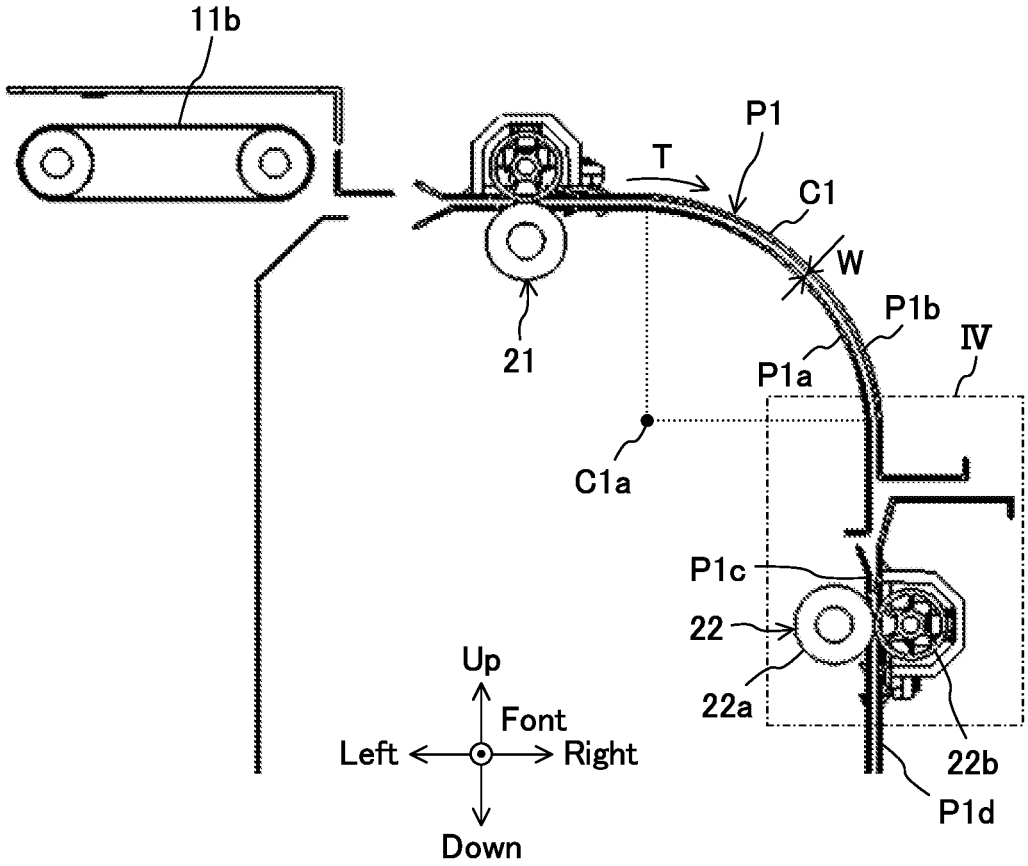
FIG. 3 is a front view showing the structure around a first curved portion in one embodiment.

FIG. 3 is a front view showing the structure around a first curved portion C1. In FIG. 3, the first entrance passage detection sensor S1 shown in FIG. 1 is left out.

As shown in FIG. 3, a first individual conveyance path P1 has a pair of guide plates P1*a*, P1*b* which are provided in a first curved portion C1 and guide a medium M, and a pair of guide plates P1*c* and P1*d* which are provided in the straight portion downstream of the first curved portion C1 and guide the medium M. As an example, the first curved portion C1 is a circular arc whose curvature center is C1*a* and whose center angle is 90 degrees.

By being provided with a first curved portion C1, a medium M in a state of being curved in a part of the conveyance direction T enters a second conveyance roller pair 22 in the first curved portion C1. Then, the second conveyance roller pair 22 conveys the medium M while nipping it. When the medium M enters the second conveyance roller pair 22, the medium M is nipped by the first conveyance roller pair 21 on the side upstream in the conveyance direction T.

Here, the second conveyance roller pair 22 is an example of a pair of conveyance members (conveyers) which are disposed in a first individual conveyance path P1 (an example of a conveyance path) and convey a medium M while nipping it. These conveyance members are not limited to rollers, but may be other conveyance members such as belts. Also, as long as a pair of conveyance members convey the medium M while nipping it in opposition to each other, one conveyance member and the other conveyance member may differ from each other in shape, size, material, or the like.

The distance W between a pair of guide plates P1*a* and P1*b* may be determined to be width within a range in which the tilt of a medium M in the conveyance direction against the conveyance direction of the guide plates P1*a* and P1*b* is a specified value or less when the medium M enters a second conveyance roller pairs 22. For example, it is desirable to repeatedly measure the tilt of the medium M to be conveyed under the conditions where the tilt of the medium M is maximal (e.g., conditions where the width and other sizes of a medium M are small and where the medium M is thin, such as conditions where thin paper of A5 size is used), and to determine the maximal distance W so that the average value, maximum value, etc., of the tilt is a specified value or less. If the distance W is narrow, it incurs a conveyance resistance of the medium M. Therefore, from the viewpoint of reducing the conveyance resistance, it is desirable that the distance W be wide. In addition, the reason why the tilt of the medium M is larger under the condition that the medium M is small in size such as width and is thin is that although a medium M incurs deformation (stress) in a first curved portion C1, a medium M large in size or a thick medium has such a large rigidity that it is less likely to incur deformation, whereas a medium M small in size or a thin medium M has less rigidity so that it incurs deformation so as to be higher in degree of freedom.

The distance W between guide plates P1*a* and P1*b* need not be constant throughout a first curved portion C1. Additionally, the measurement of the tilt may be performed in the first individual conveyance path P1 provided with a protruding portion P1*e*, that is, in the first individual conveyance path P1 that guides a medium M toward one roller of a second conveyance roller pair 22, but it may be also performed in a first individual conveyance path P1 before being provided with a protruding portion P1*e*, that is, the first individual conveyance path P1 that does not guide the medium M toward one roller of the second conveyance roller pair 22.

A pair of guide plates P1*c* and P1*d* are provided with holes for a second conveyance roller pair 22 to protrude into the conveyance route of a medium M. For example, one guide plate P1*c* is provided with a hole for the drive roller 22*a* of the second conveyance roller pair 22 to protrude into the conveyance route of the medium M, and the other guide plate P1*d* is provided with a hole for the driven roller 22*b* of the second conveyance roller pair 22 to protrude into the conveyance route of the medium M. Although a distance is present between a pair of guide plates P1*a* and P1*b* and a pair of guide plates P1*c* and P1*d*, the guide plate P1*a* and the guide plate P1*c* may be integrally provided, or the guide plate P1*b* and the guide plate P1*d* may be integrally provided.

Figure 4:
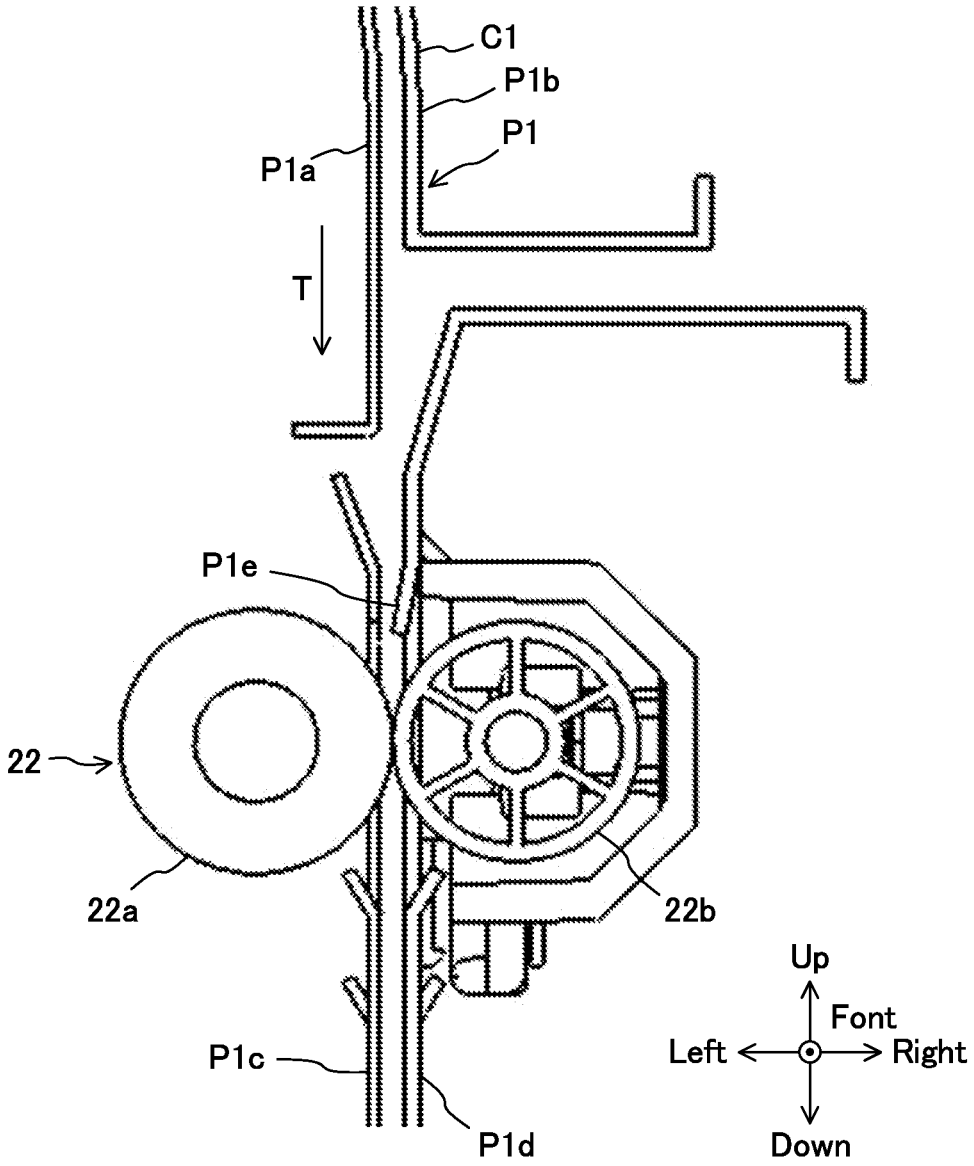
FIG. 4 is an enlarged view of section IV of FIG. 3.

As shown in FIG. 4, a guide plate P1*d* is, for example, integrally, provided with a protruding portion P1*e* that protrudes into the conveyance route of a medium M between a pair of guide plates P1*c* and P1*d*. It is desirable that this protruding portion P1*e* is provided from one side to the other side in the width direction of the medium M, or that one or more thereof are provided on both one side and the other side in the width direction of the medium M. Additionally, the protruding portion P1*e* is inclined, in order to guide the medium M toward the drive roller 22*a* of a second conveyance roller pair 22, so that as it advances in the conveyance direction T and the amount of protrusion into the conveyance route increases. Thus, the protruding portion P1*e* guides the medium M toward the drive roller 22*a* on the curvature center C1*a* side (inside) of the curved portion C1, of the second conveyance roller pair 22.

Figure 5:
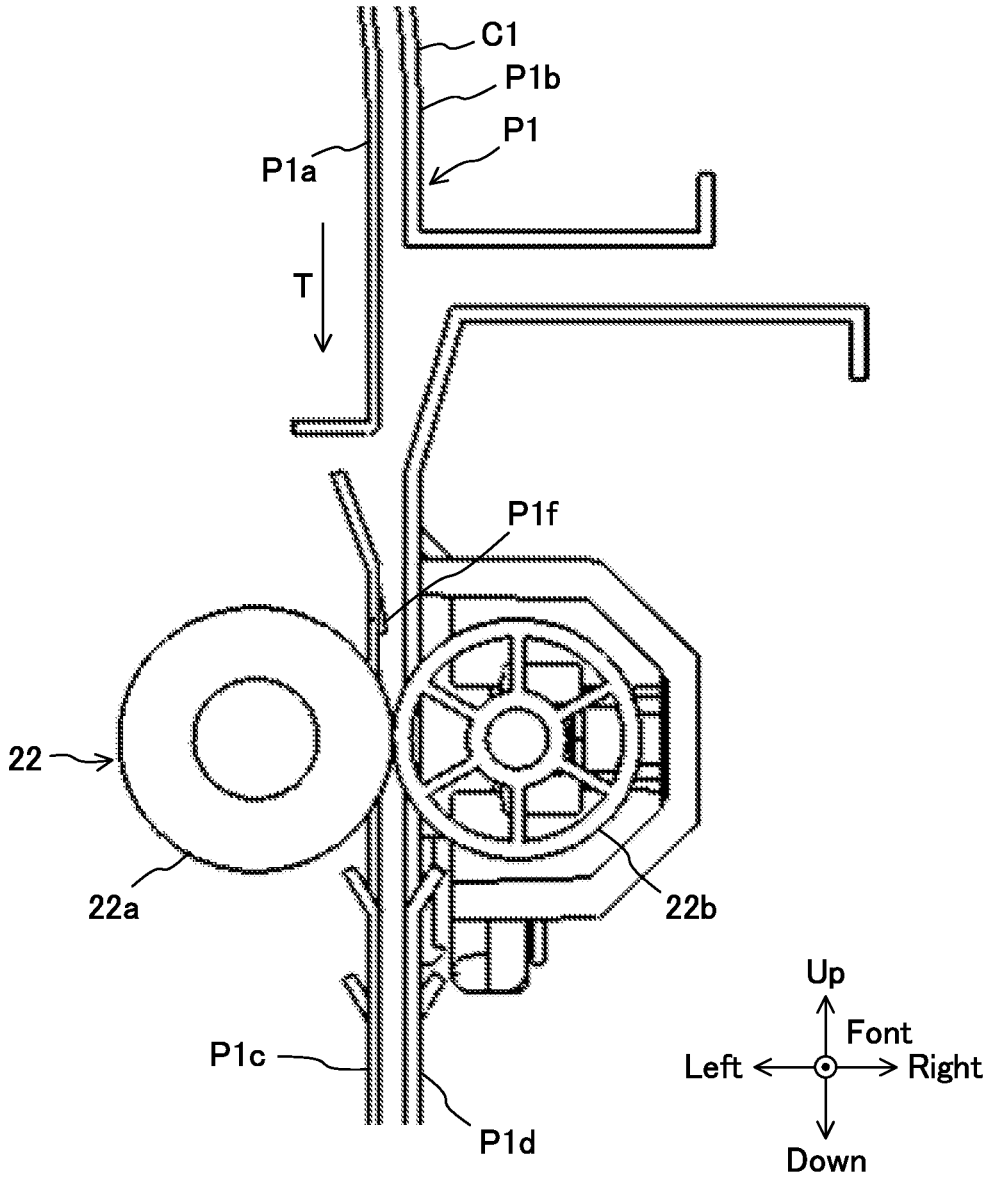
FIG. 5 is an enlarged view of section IV of FIG. 3 in a variation.

As shown in the variation shown in FIG. 5, a protruding portion P1*f* that protrudes into the conveyance route of a medium M between a pair of guide plates P1*c* and P1*d* may be, for example, integrally provided on the guide plate P1*c* instead of the guide plate P1*d*. The amount of protrusion of the protruding portion P1*f* into the conveyance route is less than the amount of protrusion of the protruding portion P1*e* shown in FIG. 4 into the conveyance route. It is desirable that the protruding portion P1*f* is provided from one side to the other side in the width direction of the medium M, or that one or more thereof are provided on both one side and the other side in the width direction of the medium M. Additionally, the protruding portion P1*f* is inclined, in order to guide the medium M toward the driven roller 22*b* of a second conveyance roller pair 22, so that as it advances in the conveyance direction T, the amount of protrusion into the conveyance route increases. Thus, the protruding portion P1*f* guides the medium M toward the driven roller 22*b* on the side (outside) opposite to the curvature center C1*a* of the curved portion C1, of the second conveyance roller pair 22.

A first individual conveyance path P1 guides a medium M toward one of a pair of conveyance members (a second conveyance roller pair 22) by having the protruding portion P1*e* or protruding portion P1*f* described above.

In order for a first individual conveyance path P1 to guide a medium M toward one roller of a second conveyance roller pair 22, for example, the first individual conveyance path P1 may guide the medium M by air blowing, or the like, via the air blowing portion of a protruding portion provided separately from a pair of guide plates P1*c* and P1*d*, or the first individual conveyance path P1. Additionally, a second conveyance roller pair 22 alone or the second conveyance roller pair 22 and both of a pair of guide plates P1*c* and P1*d* and a pair of guide plates P1*a* and P1*b* may be placed by being shifted in the direction of the thickness of the medium M, or the position of the drive roller 22*a* and the driven roller 22*b* in the conveyance direction T may be shifted to change the roller facing angle. Thus, the configuration for guiding the medium M toward one roller of the second conveyance roller pair 22 is not limited to the configuration using the protruding portions P1*e* and P1*f* provided on a pair of guide plates P1*c* and P1*d*.

Additionally, although a second conveyance roller pair 22 is disposed in the straight portion of a first individual conveyance path P1, it may be disposed in a first curved portion C1, or may be disposed in other curved portions, or the like, downstream from the first curved portion C1. In addition, although a medium M enters the second conveyance roller pair 22 in a state of being nipped by a first conveyance roller pair 21, the medium M may enter the second conveyance roller pair 22 in a state of being not nipped by the first conveyance roller pair 21. In such a case, the medium M is more likely to skew further in the first curved portion C1, and therefore, it is recommended that the distance W between a pair of guide plates P1*a* and P1*b* be determined to be further narrower under conditions where the media M is not likely to incur skewing. Here, the skewing refers to a state in which the position in the conveyance direction T differs between one side and the other side in the width direction of the medium M.

The conveyance path, of which a first individual conveyance path P1 is an example, may, for example, guide the medium M toward one roller of an eighth conveyance roller pair 28, which conveys the medium M entering in a state of being partially curved in a second curved portion C2 or a third curved portion C3 while nipping it, or may guide the medium M toward one roller of the receiving roller pair 132 described below, which conveys the medium M entering in a state of being partially curved in a fourth curved portion C4 while nipping it.

Back to FIG. 1, the first to fourth conveyance drive units D1 to D4 are motors (an example of actuators) that rotate the drive rollers of the first to ninth conveyance roller pairs 21 to 29. The first conveyance drive unit D1 rotates the drive rollers of the first and second conveyance roller pairs 21 and 22. The second conveyance drive unit D2 rotates the drive rollers of the third to fifth conveyance roller pairs 23 to 25. The third conveyance drive unit D3 rotates the drive rollers of the sixth and seventh conveyance roller pairs 26 and 27. The fourth conveyance drive unit D4 rotates the drive rollers of the eighth and ninth conveyance roller pairs 28 and 29. The first and second conveyance drive units D1 and D2, and the third conveyance drive unit D3, are examples of individual conveyance drive units (individual conveyance drives) that drive a plurality of individual conveyance portions (the first to fifth conveyance roller pairs 21-25, and the sixth and seventh conveyance roller pairs 26 and 27). The conveyance drive unit not shown in a drawing, which drives the fourth conveyance drive unit D4 and the receiving roller pair 132, are examples of a confluent conveyance drive unit (confluent conveyance drive) that drives a confluent conveyance unit (the eighth and ninth conveyance roller pairs 28 and 29 and a receiving roller pair 132).

A first entrance passage detection sensor S1, a first exit passage detection sensor S2, a second entrance passage detection sensor S3, and a second exit passage detection sensor S4 are, for example, reflective or transmissive photoelectric sensors that detect the passage of a medium M.

A first entrance passage detection sensor S1 is disposed adjacent to the first conveyance roller pair 21 on the downstream side in the conveyance direction T of the first conveyance roller pair 21. A first exit passage detection sensor S2 is disposed adjacent to the fifth conveyance roller pair 25 on the downstream side in the conveyance direction T of the fifth conveyance roller pair 25. Thus, the first entrance passage detection sensor S1 detects the passage of the medium M near the entrance of the first individual conveyance path P1, and the first exit passage detection sensor S2 detects the passage of the medium M near the exit of the first individual conveyance path P1.

A second entrance passage detection sensor S3 is disposed adjacent to a sixth conveyance roller pair 26 on the downstream side in the conveyance direction T of the sixth conveyance roller pair 26. A second exit passage detection sensor S4 is disposed adjacent to a ninth conveyance roller pair 29 on the downstream side in the conveyance direction T of the ninth conveyance roller pair 29. Thus, a second entrance passage detection sensor S3 detects the passage of the medium M near the entrance of the second individual conveyance path P2, and the second exit passage detection sensor S4 detects the passage of the medium M near the exit of the media feeding device 1 in the confluent conveyance path P3.

A first entrance passage detection sensor S1, a first exit passage detection sensor S2, and a second entrance passage detection sensor S3 are examples of a plurality of passage detection sensors that are disposed in a plurality of individual conveyance paths (a first individual conveyance path P1 and a second individual conveyance path P2) and detect the passage of a medium M before arriving at an arrival detection sensor (resist sensor S10 described below).

The control unit 31 shown in FIG. 2 has a processor (for example, CPU— Central Processing Unit) that functions as a calculation processing unit to control the operation of the entire media feeding device 1, and controls each portion of the media feeding device 1. For example, the control unit 31 controls the first to seventh conveyance roller pairs 21 to 27 (individual conveyance units), and the eighth and ninth conveyance roller pairs 28 and 29 (confluent conveyance units) using the first to fourth conveyance drive units D1 to D4. In such cases where the media feeding device 1 is integrally provided in a destination device such as a printing device 101, the control unit of the destination device (for example, the control unit 151 of the printing device 101 described below) may function as the control unit 31.

A memory unit 32 has a memory such as, for example, ROM (Read Only Memory), which is a read-only semiconductor memory in which a predetermined control program is recorded in advance, and RAM (Random Access Memory), which is a semiconductor memory that can be written and read at any time and is used as a working memory region as necessary when the processor executes various control programs. In such cases where the media feeding device 1 is integrally provided in a destination device such as a printing device 101, the memory unit of the destination device (for example, the memory unit 152 of the printing device 101 described below) may function as the memory unit 32.

An interface unit 33 transfers various information to and from external devices such as a printing device 101. For example, the interface unit 33 receives information such as a request to initiate to feed media M and a resist sensor arrival timing, from the interface unit 153 of the printing device 101, and a control unit 31 controls the operation of each portion of a media feeding device 1 based on such information.

Next, the printing device 101 is explained.

As shown in FIGS. 1 and 2, the printing device 101 includes a printing unit 110, a suction conveyance unit 120, a conveyance unit 130, a resist sensor S10, a destination conveyance path P11, a circulation reversal conveyance path P12, a reversal portion 140, a control unit 151, a memory unit 152, and an interface unit 153. In FIG. 1, a confluent conveyance path P3 and a destination conveyance path P11 are shown in solid lines, and a circulation reversal conveyance path P12 is shown in dashed lines.

A printing unit 110 has, for example, a line-head inkjet printhead for each color used for printing, which is not shown in a drawing. The printing unit 110 may use a printing method other than the inkjet printing method.

As shown in FIG. 1, a suction conveyance unit 120 is disposed in opposition to a printing unit 110. The suction conveyance unit 120 conveys a medium M by means of a conveyance belt while suctioning the medium M.

A conveyance unit 130 has a resist roller pair 131 that corrects the skewing of a medium M by the medium M conveyed toward a printing unit 110 being abutted against, a receiving roller pair 132 that conveys the medium M in a confluent conveyance path P3 that is continuous from a media feeding device 1, and a plurality of conveyance roller pairs 133 that convey the medium M in a destination conveyance path P11 or a circulation reversal conveyance path P12. The resist roller pair 131, the receiving roller pair 132, and the plurality of conveyance roller pairs 133 convey the medium M while nipping it. By the protruding portion P1*e* being provided in the first individual conveyance path P1 as described above, the medium M is suppressed from incurring skewing, but in the case where the protruding portion P1*e* were not provided, the skewing of the medium M would be substantial, and therefore, a situation could arise in which even a resist roller pair 131 could not correct the skewing.

A resist sensor S10 is disposed near a resist roller pair 131 in a confluent conveyance path P3 on the side upstream in the conveyance direction T of the resist roller pair 131. The resist sensor S10 is disposed in the confluent conveyance path P3 and is an example of an arrival detection sensor that detects the arrival timing which is an example of the arrival time of a medium M. This arrival detection sensor may be the second exit passage detection sensor S4 described above which is disposed in the confluent conveyance path P3 of a media feeding device 1. The conveyance device in this embodiment may be regarded as including the configuration of a media feeding device 1 and a conveyance route from this media feeding device 1 to the resist roller pair 131 of a printing device 101, and in that case, the receiving roller pair 132 and the resist sensor S10 can be said to be part of the conveyance device.

A destination conveyance path P11 is connected to a confluent conveyance path P3 that is continuous from a media feeding device 1 and extends downstream in the conveyance direction T from a resist roller pair 131. In the case where in the printing system 100 shown in FIG. 1, other printing devices or media discharging devices are disposed on the side downstream in the conveyance direction T of a printing device 101, the destination conveyance path P11 is connected to the conveyance paths of these devices.

In such cases where on a medium M whose one side has been subjected to printing by a printing unit 110, printing is also performed on the side opposite thereto, and the medium M is conveyed into a circulation reversal conveyance path P12.

A reversal portion 140 has a reversal path, a switchback roller pair, or the like, which reverses the front and back of a medium M conveyed into a circulation reversal conveyance path P12.

The control unit 151 shown in FIG. 2 has a processor (for example, CPU) that functions as a calculation processing unit to control the operation of the entire printing device 101.

A memory unit 152 has a memory such as, for example, ROM, which is a read-only semiconductor memory in which a predetermined control program is recorded in advance, and RAM, which is a semiconductor memory that can be written and read at any time and is used as a working memory region as necessary when the processor executes various control programs.

An interface unit 153 transfers various information to and from a media feeding device 1 and an external device such as a user terminal to which to transmit print data. For example, the interface unit 153 sends information such as a request to initiate to feed media M and a resist sensor arrival timing to the interface unit 33 of the media feeding device 1, as described above.

Each operation of feeding, conveyance and printing of a medium M will be explained below while appropriately leaving out matters that overlap with the above explanation.

First, when the interface unit 33 receives a request to initiate to feed a medium M from a printing device 101 (interface unit 153), the control unit 31 shown in FIG. 2 controls a first feeding unit 11 and a second feeding unit 12 to feed the medium M of the first feeding unit 11 and the medium M of the second feeding unit 12 which are shown in FIG. 1 alternately, or only one of them.

In the case where a control unit 31 makes a first feeding unit 11 feed a medium M, the control unit 31 controls first to fifth conveyance roller pairs 21 to 25 to convey the medium M fed by the first feeding unit 11 in a first individual conveyance path P1 by using a first conveyance drive unit D1 and a second conveyance drive unit D2. When the medium M is conveyed in the first individual conveyance path P1, its passage is detected by a first entrance passage detection sensor S1 and a first exit passage detection sensor S2. In addition, as described above, the medium M is guided by the protruding portion P1*e* shown in FIG. 4 toward the drive roller 22*a* of the second conveyance roller pair 22. Therefore, the leading edge of the medium M in the width direction is conveyed by the second conveyance roller pair 22 after it comes into contact with the drive roller 22*a*.

In the case where a control unit 31 makes a second feeding unit 12 feed a medium M, the control unit 31 controls sixth and seventh conveyance roller pairs 26 and 27 to convey the medium M fed by the second feeding unit 12 in a second individual conveyance path P2 by using a third conveyance drive unit D3. When the medium M is conveyed in the second individual conveyance path P2, its passage is detected by a second entrance passage detection sensor S3.

Additionally, the control unit 31 controls the eighth and ninth conveyance roller pairs 28 and 29 to convey the media M being conveyed from the first individual conveyance path P1 or the second individual conveyance path P2 in a confluent conveyance path P3 by using a fourth conveyance drive unit D4. When the medium M is conveyed in the confluent conveyance path P3, its passage is detected by a second exit passage detection sensor S4.

Thus, the medium M is fed to the confluent conveyance path P3 of the printing device 101 which is connected to the confluent conveyance path P3 of the media feeding device 1, and after it has its skewing corrected by being butted against the resist roller pair 131, printing is performed by the printing unit 110. When the medium M is conveyed in the confluent conveyance path P3 of the printing unit 101, its passage (arrival) is detected by the resist sensor S10. The arrival timing of this medium M to the resist sensor S10 is sent from the printing device 101 (interface unit 153) to the media feeding device 1 (interface unit 33).

In this embodiment described above, a conveyance device (for example, a media feeding device 1) includes a first individual conveyance path P1 (an example of a conveyance path) having a first curved portion C1 (an example of a curved portion), and a second conveyance roller pair 22 (an example of a pair of conveyers) which is disposed in this first individual conveyance path P1 and conveys a medium M while nipping it. The medium M enters this second conveyance roller pair 22 in a state of being at least partially curved in the first curved portion C1, and the first individual conveyance path P1 guides the medium M toward the drive roller 22*a* which is one example of one roller of the second conveyance roller pair 22.

Thus, by guiding a medium M entering a second conveyance roller pair 22 in a state of being at least partially curved in a first curved portion C1 toward the drive roller 22*a* which is one roller of the second conveyance roller pair 22, the tip of the medium M which has increased in degree of freedom in the first curved portion C1 can be brought into contact with only the drive roller 22*a* out of the drive roller 22*a* and the driven roller 22*b*, or be made to easily enter the middle position of the second conveyance roller pair 22. Therefore, the medium M can be suppressed from incurring the skewing due to the difference in frictional force (conveyance force) between the drive roller 22*a* and the driven roller 22*b* which occurs in the case where the tip of the medium M comes into contact with the drive roller 22*a* on one side in the width direction and comes into contact with the driven roller 22*b* on the other side. In addition, even if a sensor to detect the skewing of the medium M, a skewing correction unit to correct the skewing of the medium M, or the like is not disposed, the medium M can be suppressed from incurring skewing, and therefore, a conveyance device can be configured to be simple.

Accordingly, this embodiment allows the medium M to be suppressed from incurring skewing with a simple configuration.

Additionally, in this embodiment, a first individual conveyance path P1 has protruding portions P1*e* and P1*f* that protrude into the conveyance path of a medium M, and these protruding portions P1*e* and P1*f* guide the medium M toward one roller of the second conveyance roller pair 22 (a drive roller 22*a* or a driven roller 22*b*).

Thus, with a simple configuration using protruding portions P1*e* and P1*f*, the tip of a medium M can be more reliably prevented from coming into contact with a drive roller 22*a* on one side in the width direction and coming into contact with a driven roller 22*b* on the other side. Therefore, the medium M can be far more effectively suppressed from incurring skewing.

Additionally, in this embodiment, a first curved portion C1 includes a pair of guide plates P1*a*, P1*b* that guide a medium M, and the distance W between this pair of guide plates P1*a* and P1*b* is determined to be wide within a range in which the tilt of the conveyance direction of the medium M against the conveyance direction T of the guide plates P1*a* and P1*b* is a specified value or less when the medium M enters a second conveyance roller pair 22.

Thus, the tip of a medium M which has increased in degree of freedom in a first curved portion C1 can be more reliably prevented from coming into contact with a drive roller 22*a* on one side in the width direction and coming into contact with a driven roller 22*b* on the other side. Therefore, the medium M can be far more effectively suppressed from incurring skewing. In addition, since the medium M can be suppressed from incurring the conveyance resistance which increases in the case where the distance W becomes narrower, the medium M can be suppressed from decreasing in conveyance speed.

Additionally, in this embodiment, a first individual conveyance path P1 guides a medium M toward the drive roller 22*a* on the curvature center C1*a* side of a first curved portion C1 of a second conveyance roller pair 22.

Thus, in a first curved portion C1, a medium M gets closer to the outer side thereof which is the side opposite to the curvature center C1*a* of the first curved portion C1 due to centrifugal force, and therefore, the medium M made close to the outer side in this way, for example, can easily come into contact with a protruding portion P1*e*, and thereby, becomes easy to guide to the drive roller 22*a* side.

Additionally, in the variation of this embodiment (FIG. 5), a first individual conveyance path P1 guides a medium M toward a driven roller 22*b* which is on the side opposite to the curvature center C1*a* of the curved portion C1 of a second conveyance roller pair 22.

Thus, since in a first curved portion C1 a medium M gets closer to the outer side thereof (the driven roller 22*b* side) which is the side opposite to the curvature center C1*a* of the first curved portion C1 due to centrifugal force, the medium M becomes easy to guide to the driven roller 22*b* side. Therefore, for example, in the case where a protruding portion P1*f* for guiding a medium M is used as shown in FIG. 5, a simpler configuration with the protruding portion P1*f* which protrudes less can be obtained than in the case where a protruding portion P1*e* for guiding the medium M toward the drive roller 22*a* is used as shown in FIG. 4.

The present invention is not simply limited to the embodiments described herein. Components of the embodiments may be embodied in a varied manner in an implementation phase without departing from the gist of the invention. A plurality of components disclosed with reference to the described embodiments may be combined, as appropriate, to achieve various inventions. For example, all of the components indicated with reference to embodiments may be combined as appropriate. Accordingly, various variations and applications can be provided, as a matter of course, without departing from the gist of the invention. The following indicates, as appendixes, the invention set forth in the claims of the corresponding Japanese application as originally filed.

In an aspect, this application relates to the following.

A conveyance device comprising:

a conveyance path having a curved portion; and a pair of conveyers that are disposed in the conveyance path and convey a medium while nipping it, wherein the medium enters the pair of conveyers in a state of being at least partially curved in the curved portion, and the conveyance path guides the medium toward one of the pair of conveyers.

In another aspect, the conveyance path has a protruding portion that protrudes into a conveyance route of the medium, and the protruding portion guides the medium toward one of the pair of conveyers.

In another aspect, the curved portion includes a pair of guide plates that guides the medium, and the distance between the pair of guide plates is determined to be wide within a range in which the tilt of the conveyance direction of the medium against the conveyance direction of the guide plates is a specified value or less when the medium enters the pair of conveyers.

In another aspect, the conveyance path guides the medium toward a conveyer on the curvature center side of the curved portion, of the pair of conveyers.

In another aspect, the conveyance path guides the medium toward a conveyer on the side opposite to the curvature center of the curved portion, of the pair of conveyers.

The invention claimed is:

1. A conveyance device comprising:

a first conveyance path conveying a first medium having a horizontal portion, a curved portion downstream of the horizontal portion, and a vertical portion downstream of the curved portion;

a second conveyance path positioned vertically below the first conveyance path and conveying a second medium;

a third conveyance path downstream from the first and second conveyance paths and configured to receive the first medium from the first conveyance path and the second medium from the second conveyance path;

wherein the first conveyance path includes:

a first feeder in the first conveyance path, holding plural first mediums, and configured to feed the first mediums horizontally:

a first pair of opposed rollers that are disposed in the first conveyance path, receive the first medium from the first feeder, and convey the first medium horizontally through a nip of the first pair of opposed rollers so that the first medium is horizontally ejected from the downstream side of the nip in the first conveyance path, wherein the curved portion of the first conveyance path changes the direction of conveyance of the first medium horizontally ejected from the nip from a horizontal direction to a vertical direction;

a first driver;

a second pair of opposed rollers positioned below the first pair of opposed rollers in the vertical direction, disposed in the first conveyance path downstream of the first pair of opposed rollers so as to vertically receive the vertically conveyed first medium, vertically ejecting the first medium from a nip of the second pair of opposed rollers, conveying the vertically-ejected medium to a printer device via the third conveyance path while nipping the first medium, and at least one of which is driven by the first driver;

a guide positioned below the first pair of opposed rollers and above the second pair of opposed rollers in the vertical direction and having a protrusion protruding into the first conveyance path upstream of the second pair of opposed rollers and downstream of the first pair of opposed rollers, wherein the first medium enters the second pair of opposed rollers in a state of being at least partially curved in the curved portion, and wherein the protrusion of the guide guides the first medium toward the one of the second pair of opposed rollers and away from the other of the second pair of opposed rollers;

a third pair of opposed rollers positioned vertically below the second pair of opposed rollers in the first conveyance path to receive the first medium from the second pair of opposed rollers; and a second driver configured to drive at least one of the third pair of opposed rollers;

wherein the second conveyance path includes:

a second feeder in the second conveyance path vertically below and aligned with the first feeder, holding plural second mediums, and configured to feed the second mediums horizontally;

a fourth pair of opposed rollers positioned in the second conveyance path to receive the second medium from the second feeder horizontally; and a third driver configured to drive at least one of the fourth pair of opposed rollers to feed the second medium along the second conveyance path to the third conveyance path.

2. The conveyance device according to claim 1, wherein the curved portion includes a pair of guide plates that guides the first medium, and the distance between the pair of guide plates is determined to be wide within a range in which the tilt of the conveyance direction of the first medium against the conveyance direction of the guide plates is a specified value or less when the first medium enters the second pair of opposed rollers.

3. The conveyance device according to claim 1, wherein the first conveyance path guides the first medium toward a roller on the curvature center side of the curved portion, of the second pair of opposed rollers.

4. The conveyance device according to claim 1, wherein the first conveyance path guides the first medium toward a roller on the side opposite to the curvature center of the curved portion, of the second pair of opposed rollers.

5. The conveyance device according to claim 1, wherein the guide has a linear portion upstream of the second pair of opposed rollers and downstream of the first pair of opposed rollers, and the protrusion of the guide protrudes into the first convenance path and is inclined with respect to the linear portion at an acute angle toward one of the second pair of opposed rollers and away from the other of the second pair of opposed rollers to guide the first medium toward one of the second pair of opposed rollers and away from the other of the second pair of opposed rollers, thereby preventing skewing of the first medium.

6. The conveyance device according to claim 1, wherein the protrusion of the guide is inclined so that the amount of protrusion into the first conveyance path increases as it advances in the conveyance direction of the first medium.

* * * * *